US010500877B2

(12) United States Patent
Ueyama

(10) Patent No.: US 10,500,877 B2
(45) Date of Patent: Dec. 10, 2019

(54) TRANSPORT APPARATUS, PRINTING APPARATUS

(71) Applicant: SEIKO EPSON CORPORATION, Tokyo (JP)

(72) Inventor: Naohiro Ueyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/908,544

(22) Filed: Feb. 28, 2018

(65) Prior Publication Data

US 2018/0250963 A1 Sep. 6, 2018

(30) Foreign Application Priority Data

Mar. 1, 2017 (JP) ..... 2017-038473

(51) Int. Cl.

| | |
|---|---|
| ***B41J 15/04*** | (2006.01) |
| ***B41J 15/02*** | (2006.01) |
| ***B41J 15/16*** | (2006.01) |
| ***B41J 29/38*** | (2006.01) |
| *B65H 23/18* | (2006.01) |
| *B65H 23/08* | (2006.01) |

(52) U.S. Cl.

CPC ..... *B41J 15/04* (2013.01); *B41J 15/02* (2013.01); *B41J 15/042* (2013.01); *B41J 15/16* (2013.01); *B41J 29/38* (2013.01); *B65H 23/085* (2013.01); *B65H 23/1813* (2013.01)

(58) Field of Classification Search

CPC . B41J 15/04; B41J 15/16; B41J 15/02; B65H 23/085; B65H 23/1813

See application file for complete search history.

(56) References Cited

U.S. PATENT DOCUMENTS

| | | | |
|---|---|---|---|
| 2009/0226235 | A1 | 9/2009 | Kobayashi et al. |
| 2012/0182366 | A1 | 7/2012 | Kobayashi et al. |
| 2015/0035921 | A1 | 2/2015 | Satake |

FOREIGN PATENT DOCUMENTS

| | | | | |
|---|---|---|---|---|
| JP | 2009-132163 | A | | 6/2009 |
| JP | 2009-214985 | A | | 9/2009 |
| JP | 2015-030545 | A | | 2/2015 |
| JP | 2016026974 | A | * | 2/2016 |

* cited by examiner

*Primary Examiner* — Sharon A. Polk
(74) *Attorney, Agent, or Firm* — Workman Nydegger

(57) ABSTRACT

A transport apparatus includes: a support unit that supports a roll; a drive unit that rotates the support unit; a cover configured to cover at least part of the support unit; and a load applying unit that applies a load to the support unit, wherein the cover is movable between a closed position at which the cover covers at least part of the support unit and an open position which is different from the closed position, and the load applying unit applies a large load to the support unit when the cover is located at the closed position compared with the case where the cover is located at the open position.

10 Claims, 6 Drawing Sheets

TRANSPORT APPARATUS, PRINTING APPARATUS

BACKGROUND

1. Technical Field

The present invention relates to a transport apparatus for transporting a medium and a printing apparatus which includes the transport apparatus.

2. Related Art

Known examples of the printing apparatus include ink jet printers configured to eject ink onto a roll paper (medium) for recording (printing). Some of such printers are provided with a transport apparatus for transporting a roll paper pulled out from a roll. JP-A-2009-214985 is an example of related art.

The transport apparatus of JP-A-2009-214985 includes a transport roller for transporting a roll paper and a tension generating member for generating tension to a roll paper, and is configured to transport a roll paper while applying a tension to the roll paper.

In this transport apparatus, rotation of the roll paper is controlled so that a constant tension is applied to the pulled out roll paper. As a consequence, when the roll paper is set in the transport apparatus and the leading end of the roll paper is pulled out to the transport roller, rotation of the roll paper is also limited, which causes difficulty in pulling out of the roll paper.

This issue is generally common to the printing apparatuses which include a transport apparatus for transporting a roll-shaped medium.

SUMMARY

An advantage of some aspects of the invention is that a transport apparatus that successfully transports a medium by preventing a decrease in operability during setting of a medium is provided. Further, another advantage of some aspects of the invention is that a printing apparatus which includes the transport apparatus is provided.

The following describes means for solving the above problem and the advantageous effect thereof. An aspect of a transport apparatus for solving the above problem includes a support unit that supports a roll-shaped medium, a drive unit that rotates the support unit, a cover configured to cover at least part of the support unit, and a load applying unit that applies a load to the support unit, wherein the cover is movable between a closed position at which the cover covers at least part of the support unit and an open position which is different from the closed position, and the load applying unit applies a large load to the support unit when the cover is located at the closed position compared with the case where the cover is located at the open position.

With this configuration, when the cover is located at the closed position, rotation of the medium supported by the support unit can be limited since a large load is applied to the support unit by the load applying unit. On the other hand, when the cover is located at the open position, the medium of the roll-shape supported by the support unit can be easily pulled out. Accordingly, the cover can be moved to the open position for setting of the medium and can be moved to the closed position for transporting the medium to thereby prevent a decrease in operability during setting of the medium and successfully transport the medium.

In the above aspect of the transport apparatus, it is preferred that the support unit includes a shaft inserted into the roll-shaped medium, and a flange having a diameter larger than that of the shaft, wherein the load applying unit applies a load to the flange.

With this configuration, since the load applying unit applies a load to the flange having a diameter larger than that of the shaft, the moment can be increased compared with the case of applying a load to the shaft having a small diameter. Accordingly, the load applying unit can efficiently apply a load to the support unit.

In the above aspect of the transport apparatus, it is preferred that the load applying unit is disposed on the cover. With this configuration, since the load applying unit is disposed on the cover, the load applying unit can be moved along with movement of the cover. Accordingly, the amount of load applied by the load applying unit can be easily changed.

In the above aspect of the transport apparatus, it is preferred that the load applying unit is disposed on the support unit. The position of the support unit that supports the medium varies depending on the width of the medium. In this regard, according to this configuration, the friction member, which is disposed on the support unit, can apply a load to the support unit while easily accommodating to varying positions of the support unit.

In the above aspect of the transport apparatus, it is preferred that the load applying unit applies a load to the support unit in the radial direction. With this configuration, since the load applying unit applies a load to the support unit in the radial direction, it can efficiently apply a load to the support unit compared with the case of applying a load in the direction different from the radial direction.

In the above aspect of the transport apparatus, it is preferred that the load applying unit includes a rotary damper that applies resistance to rotation of the support unit, the support unit and the rotary damper are connected to each other when the cover is located at the closed position, and the support unit and the rotary damper are disconnected from each other when the cover is located at the open position.

With this configuration, when the cover is located at the closed position, the load applying unit applies a large load to the support unit by connecting the support unit and the rotary damper to each other. On the other hand, when the cover is located at the open position, the load applying unit releases the connection between the support unit and the rotary damper. Accordingly, connection state between the support unit and the rotary damper can be changed by moving the cover.

An aspect of a printing apparatus includes the transport apparatus having the above configuration, and a print unit that performs printing on the medium. With this configuration, the same effects as those of the above transport apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to the drawings, a first embodiment of a printing apparatus which includes a transport apparatus will be described. The printing apparatus according to the present embodiment is an ink jet printer that performs printing (recording) by ejecting ink which is an example of liquid onto a medium such as a paper sheet.

Figure 1:
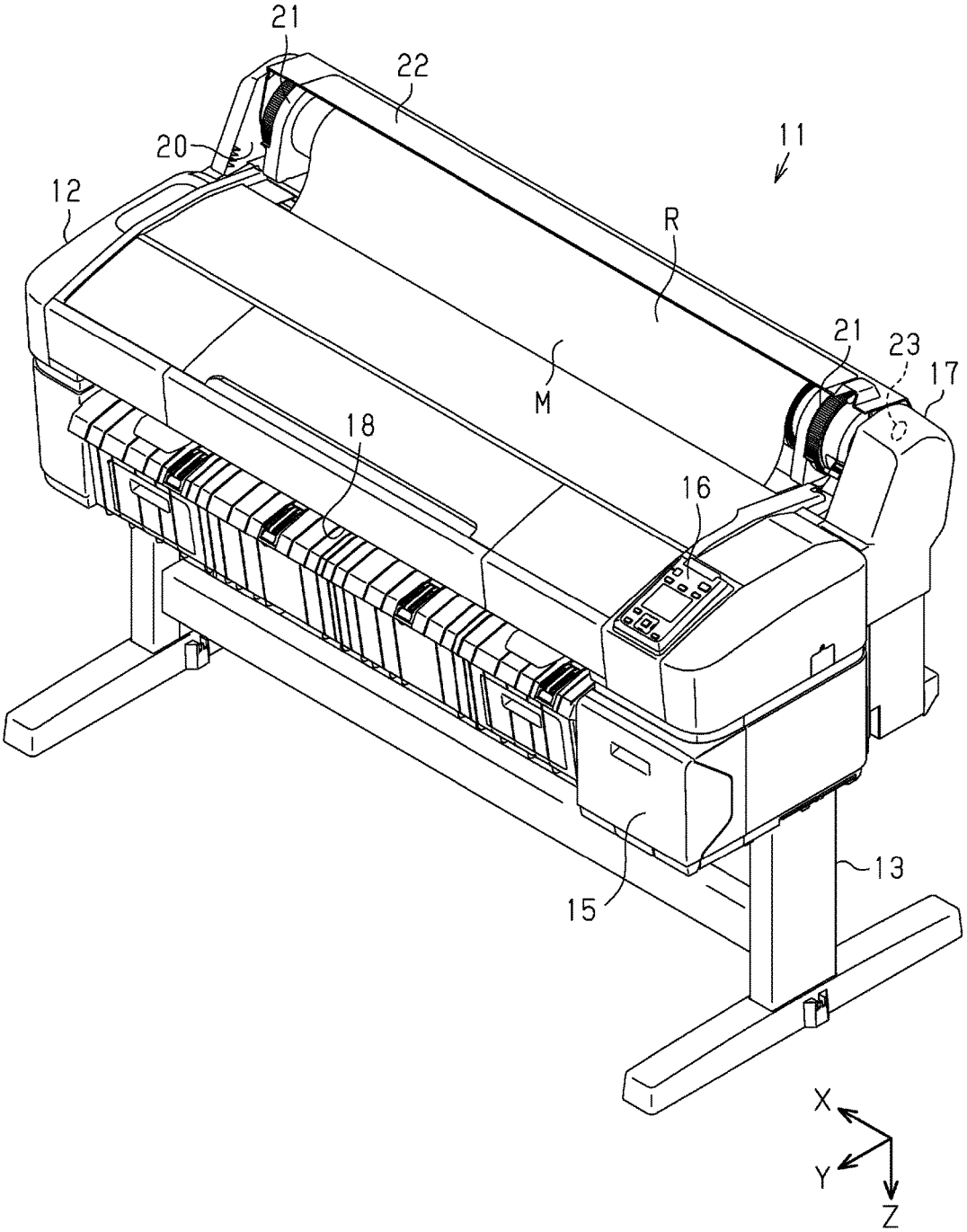
FIG. 1 is a perspective view of a first embodiment of a printing apparatus which includes a transport apparatus.

As shown in FIG. 1, a printing apparatus 11 includes a housing 12 having predetermined height, depth, and width when placed for use, and a stand 13 that supports the housing 12.

In the present embodiment, a width direction and a depth direction are substantially horizontal. Assuming that the printing apparatus 11 is placed on the horizontal plane, a gravitational direction is indicated by the Z axis. A direction from back to front (forward) in the depth direction is indicated by the Y axis. The width direction is indicated by the X axis, which is perpendicular to both the Z axis and the Y axis. The X axis, Z axis, and Y axis are coordinate axes which represent the width, height, and depth, respectively.

The printing apparatus 11 includes a holding unit 15 disposed on the front side of the housing 12, an operation unit 16 for operating the printing apparatus 11, and a transport apparatus 17 for transporting a medium M such as a paper sheet. The holding unit 15 holds a liquid container (not shown in the figure) that stores liquid such as ink in a detachable manner. An output port 18 is formed on the front side of the housing 12 so that the printed medium M is output to the outside of the housing 12 through the output port 18.

The transport apparatus 17 includes a container 20 configured to house a roll R which is an example of a roll-shaped medium M, a pair of support units 21 that supports the roll R, and a cover 22 configured to cover the container 20. The transport apparatus 17 transports the medium M which is fed out or pulled out from the roll R.

The cover 22 is configured to rotate about a rotation shaft 23 and movable between an open position (see FIG. 1) and a closed position (see FIG. 2) which is different from the open position. When the cover 22 is at the open position, the container 20 is at least partially exposed to the outside so that the support unit 21 and the roll R can be stored or replaced.

Figure 2:
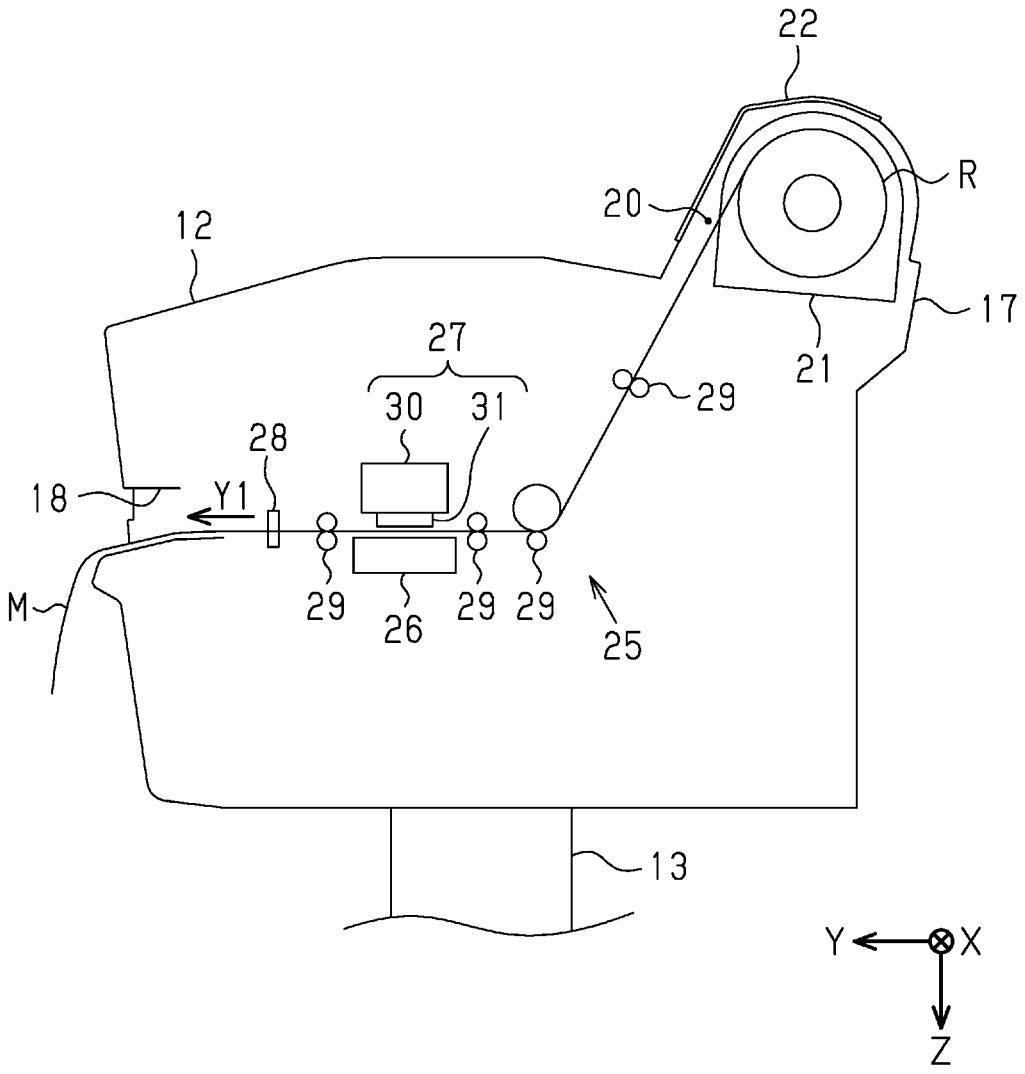
FIG. 2 is a schematic view which illustrates an inner configuration of the printing apparatus.

As shown in FIG. 2, when located at the closed position, the cover 22 can cover at least part of the support unit 21. In the present embodiment, the cover 22 located at the closed position covers the container 20, the support unit 21, and the roll R from front and above. The housing 12 covers the container 20, the support unit 21, and the roll R from back and both sides in the width direction. Accordingly, the cover 22 located at the closed position and the housing 12 surround the container 20, the support unit 21, and the roll R to thereby reduce the risk of contamination of the container 20 and the housing 12 due to dust which may attach to the medium M or the like. When located at the closed position, the cover 22 preferably covers the roll R and the support unit 21 to an extent that does not allow replacement of the roll R.

The housing 12 houses a transport unit 25 that transports the medium M, a support table 26 that supports the medium M, a print unit 27 that performs printing onto the medium M, and a cutting unit 28 that cuts the medium M. The transport apparatus 17 may be configured to include the transport unit 25.

The transport unit 25 includes at least one (in this embodiment, four) transport roller 29 that supports the medium M from both the front and back surfaces of the medium M. As the transport rollers 29 rotate, the transport unit 25 pulls out the medium M from the container 20 located upstream in the transport direction Y1 and transports the medium M toward the output port 18 located downstream in the transport direction Y1. The transport direction Y1 is a direction different from (preferably, perpendicular to) the width direction.

The print unit 27 and the support table 26 are disposed at positions adjacent to the transport path of the medium M on both sides of the transport path. The print unit 27 performs printing of an image such as letters or pictures onto the medium M supported by the support table 26. The print unit 27 includes a carriage 30 which can reciprocate in the width direction (scan direction), and a liquid ejecting head 31 mounted on the carriage 30. The liquid ejecting head 31 performs printing on the medium M by ejecting ink onto the medium M. The cutting unit 28 cuts the medium M printed by the print unit 27.

Figure 3:
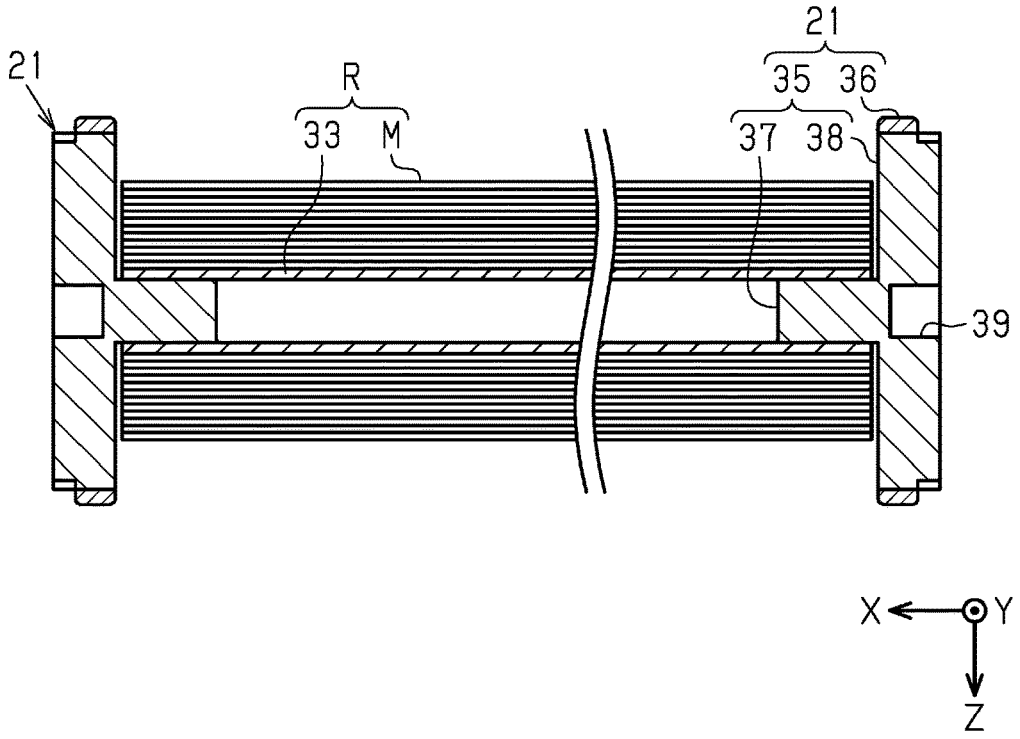
FIG. 3 is a schematic cross-sectional view of a roll on which a support unit is mounted.

As shown in FIG. 3, the roll R includes a core 33 of a cylindrical shape with both ends in the width direction being open, and the elongated medium M is rolled around the core 33. The pair of support units 21 supports the roll R from both sides in the width direction, and is detachably attached to the container 20. The roll R may have any width in the width direction as long as it is shorter than the width of the container 20. The positions of (distance between) the support units 21 in the width direction vary depending on the width of the roll R.

Figure 4:
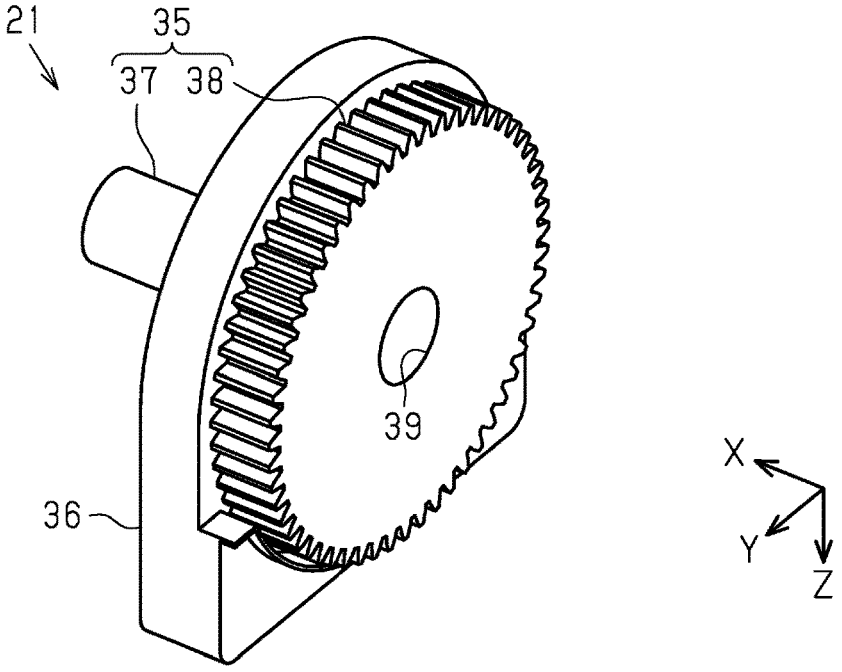
FIG. 4 is a schematic perspective view of the support unit.

Next, the support unit 21 will be described. The pair of support units 21 has an identical configuration. As shown in FIGS. 3 and 4, the support unit 21 includes a rotary unit 35 that is rotatable with the roll R, and a frame 36 that supports the rotary unit 35 in a rotatable manner. The rotary unit 35 includes a shaft 37 inserted into the core 33 of the roll R, and a flange 38 having a diameter larger than that of the shaft 37.

As shown in FIG. 4, the flange 38 has a substantially circular shape in side view as viewed in the width direction. A gear is formed on the rim of the flange 38. An engagement section 39 configured to engage with an output shaft 45 (see FIG. 5) is formed as a circular hole at the center of the flange 38. The engagement section 39 and the output shaft 45 may have a protrusion and a recess, respectively, so that they engage with each other.

Figure 5:
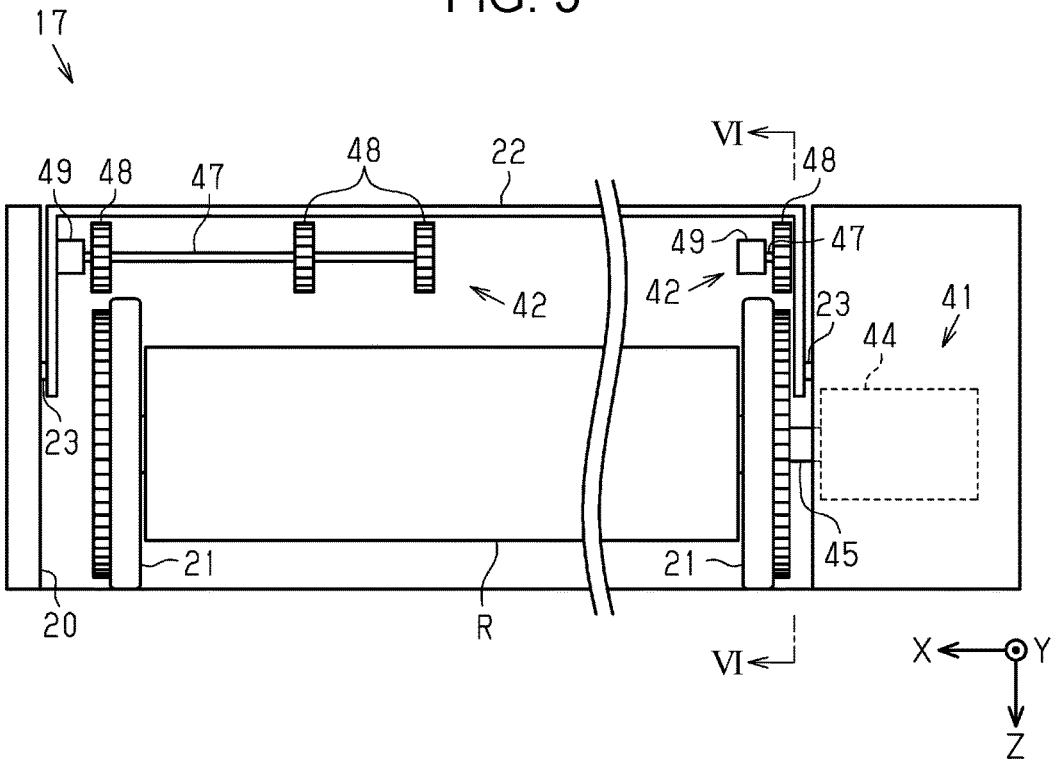
FIG. 5 is a schematic front view of the transport apparatus in which a cover is at an open position.

Next, a configuration of the transport apparatus 17 for applying a tension specifically to the medium M will be described. As shown in FIG. 5, the transport apparatus 17 includes a drive unit 41 that rotates the rotary unit 35 of the support unit 21 and a load applying unit 42 that applies a load to the rotary unit 35 of the support unit 21.

The drive unit 41 includes a driving source 44 such as a motor and an output shaft 45 for outputting power from the driving source 44. The output shaft 45 extends in the width direction with the distal end being positioned in the container 20. The drive unit 41 rotates the rotary unit 35 and the roll R when driving while being connected with one of the pair of support units 21 which is located close to the drive unit 41. Specifically, as the drive unit 41 rotates in the forward direction, the roll R rotates in the feeding out direction by which the medium M is paid out from the roll R. On the other hand, as the drive unit 41 rotates in the backward direction, the roll R rotates in the winding direction by which the medium M is wound around the roll R.

At least one (in this embodiment, two) load applying unit 42 is disposed on the cover 22. The load applying unit 42 includes a driven shaft 47 which extends in the width direction, a driven gear 48 disposed on the driven shaft 47, and a rotary damper 49 that controls rotation of the driven shaft 47. A plurality of driven gears 48 may be provided in accordance with the positions of the support unit 21 depending on the width of the roll R.

Figure 6:
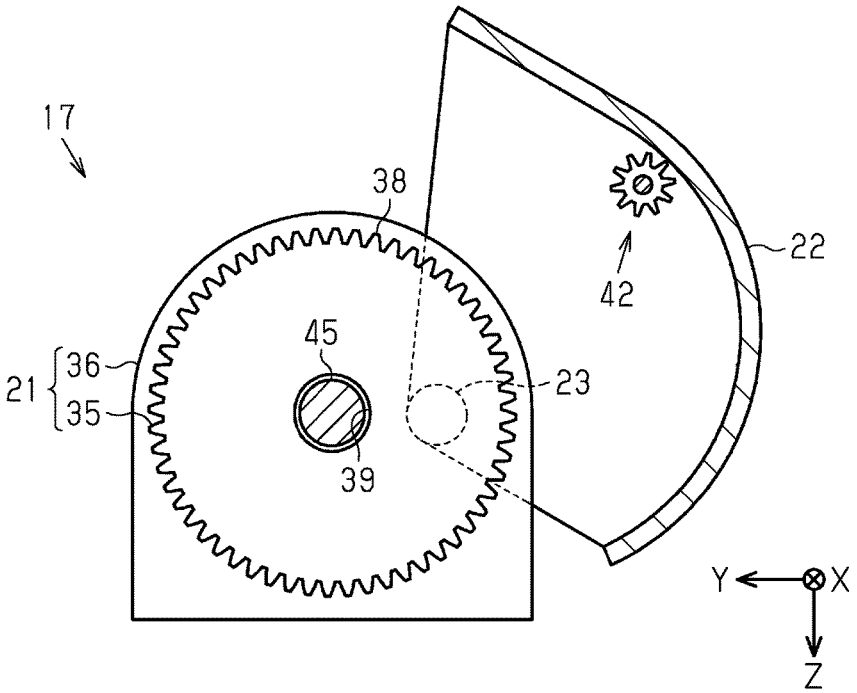
FIG. 6 is a schematic cross-sectional view taken along the arrow VI-VI of FIG. 5.

As shown in FIG. 6, the rotation shaft 23 which serves as the rotation center of the cover 22 is located at a position different from the output shaft 45 which serves as the rotation center of the roll R. The rotation shaft 23 of the present embodiment is disposed on the rear side of the output shaft 45. The cover 22 moves upward and backward from the closed position to the open position. Accordingly, as the cover 22 moves from the closed position to the open position, it moves spaced from the support unit 21.

Figure 7:
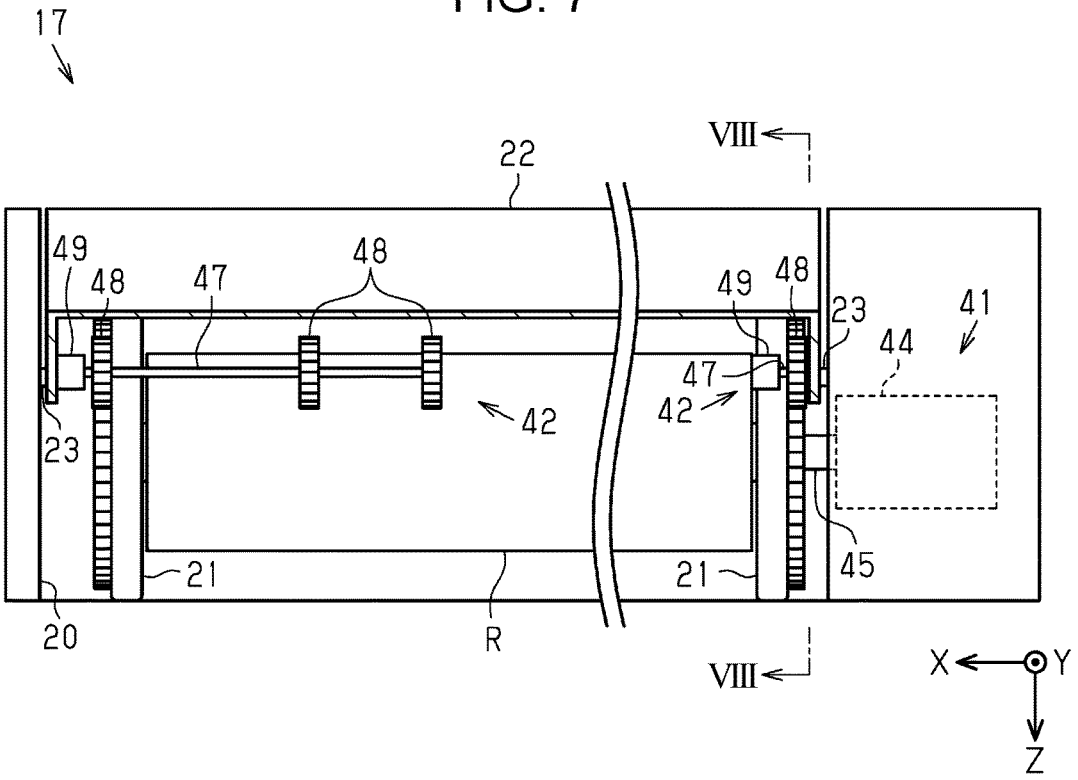
FIG. 7 is a schematic front view of the transport apparatus in which a cover is at a closed position.
Figure 8:
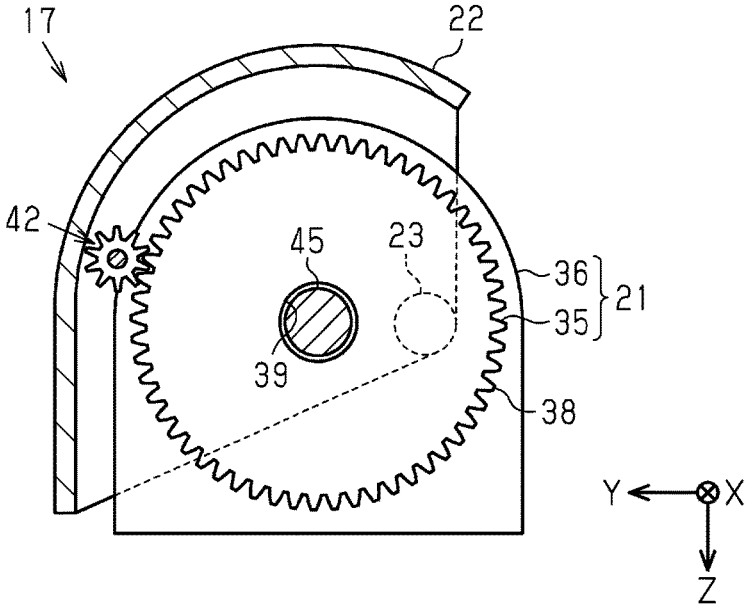
FIG. 8 is a schematic cross-sectional view taken along the arrow VIII-VIII of FIG. 7.

As shown in FIGS. 5 to 8, the load applying unit 42 moves along with movement of the cover 22. Specifically, as shown in FIGS. 5 and 6, when the cover 22 is at the open position, the load applying unit 42 is located at a separate position which is spaced from the support unit 21. As shown in FIGS. 7 and 8, when the cover 22 is at the closed position, the load applying unit 42 is located at a connected position at which it is connected to the rotary unit 35 of the support unit 21.

Next, an effect of printing by the transport apparatus 17 with the medium M will be described. As shown in FIGS. 5 and 6, in setting of the medium M, a user moves the cover 22 to the open position and inserts the roll R on which the support unit 21 is mounted into the container 20. The user moves the support unit 21 together with the roll R to a position close to the drive unit 41 to thereby connect the support unit 21 to output shaft 45. Then, the user pulls out the medium M from the roll R, and allows the transport rollers 29 to nip the pulled out medium M to thereby set the medium M into the transport path.

When the medium M is set, the cover 22 is at the open position. Accordingly, the driven gear 48 is located at the separated position spaced from the flange 38, and the support unit 21 is disconnected from the rotary damper 49. As a result, the rotary unit 35 and the roll R easily rotate in the feeding out direction.

As shown in FIGS. 7 and 8, when setting of the medium M is complete, the user moves the cover 22 from the open position to the closed position. Accordingly, the load applying unit 42 moves to the connected position by which the driven gear 48 mates with the gear formed on the flange 38. That is, when the cover 22 is located at the closed position, the support unit 21 and the rotary damper 49 are connected with each other, and the rotary damper 49 applies resistance to the rotation of the rotary unit 35 of the support unit 21. As a result, when the cover 22 is located at the closed position, the load applying unit 42 applies a large load to the support unit 21 compared with the case where the cover 22 is located at the open position. The load applying unit 42 of the present embodiment does not apply a load when the cover 22 is located at the open position, and applies a load to the flange 38 when the cover 22 is located at the closed position.

Printing of the medium M is performed with the cover 22 being moved to the closed position. After the transport unit 25 pulls out the medium M, the drive unit 41 rotates in the forward or backward direction to thereby rotate the roll R to apply an appropriate tension to the medium M. Meanwhile, the load applying unit 42, which applies a load to the support unit 21, limits an inertial rotation of the roll R to stop the rotation of the roll R.

According to the above first embodiment, the following advantageous effects can be obtained.

(1-1) When the cover 22 is located at the closed position, rotation of the medium M supported by the support unit 21 can be limited since a large load is applied to the support unit 21 by the load applying unit 42. On the other hand, when the cover 22 is located at the open position, the medium M of the roll-shape supported by the support unit 21 can be easily pulled out. Accordingly, the cover 22 can be moved to the open position for setting of the medium M and can be moved to the closed position for transporting the medium M to thereby prevent a decrease in operability during setting of the medium M and successfully transport the medium M.

(1-2) Since the load applying unit 42 applies a load to the flange 38 having a diameter larger than that of the shaft 37, the moment can be increased compared with the case of applying a load to the shaft 37 having a small diameter. Accordingly, the load applying unit 42 can efficiently apply a load to the support unit 21.

(1-3) Since the load applying unit 42 is disposed on the cover 22, the load applying unit 42 can be moved along with movement of the cover 22. Accordingly, the amount of load applied by the load applying unit 42 can be easily changed.

(1-4) When the cover 22 is located at the closed position, the load applying unit 42 applies a large load to the support unit 21 by connecting the support unit 21 and the rotary damper 49 to each other. On the other hand, when the cover 22 is located at the open position, the load applying unit 42 releases the connection between the support unit 21 and the rotary damper 49. Accordingly, connection state between the support unit 21 and the rotary damper 49 can be changed by moving the cover 22.

(1-5) Since the transport apparatus 17 includes a plurality of load applying units 42 disposed at different positions in the width direction, the load applied to the roll R can be distributed compared with the case of having a single load applying unit 42.

Second Embodiment

With reference to the drawings, a second embodiment of the printing apparatus will be described. The second embodiment differs from the first embodiment in the configuration of the load applying unit. Since the remaining is the same as the first embodiment, the same configurations are designated by the same reference characters, and the duplicated description thereof will be omitted.

Figure 9:
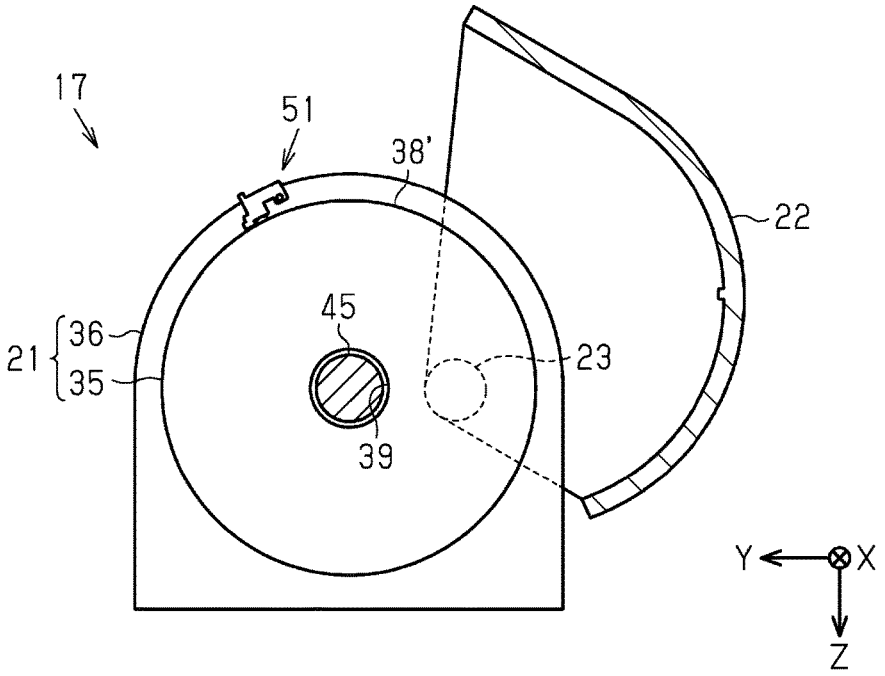
FIG. 9 is a schematic view of a second embodiment of the transport apparatus.

As shown in FIG. 9, the support unit 21 includes a friction member 51 which is an example of the load applying unit. The flange 38' of the present embodiment does not necessarily have a gear on the rim. As the cover 22 moves from the open position to the closed position, it moves close to the friction member 51 and the support unit 21.

Figure 10:
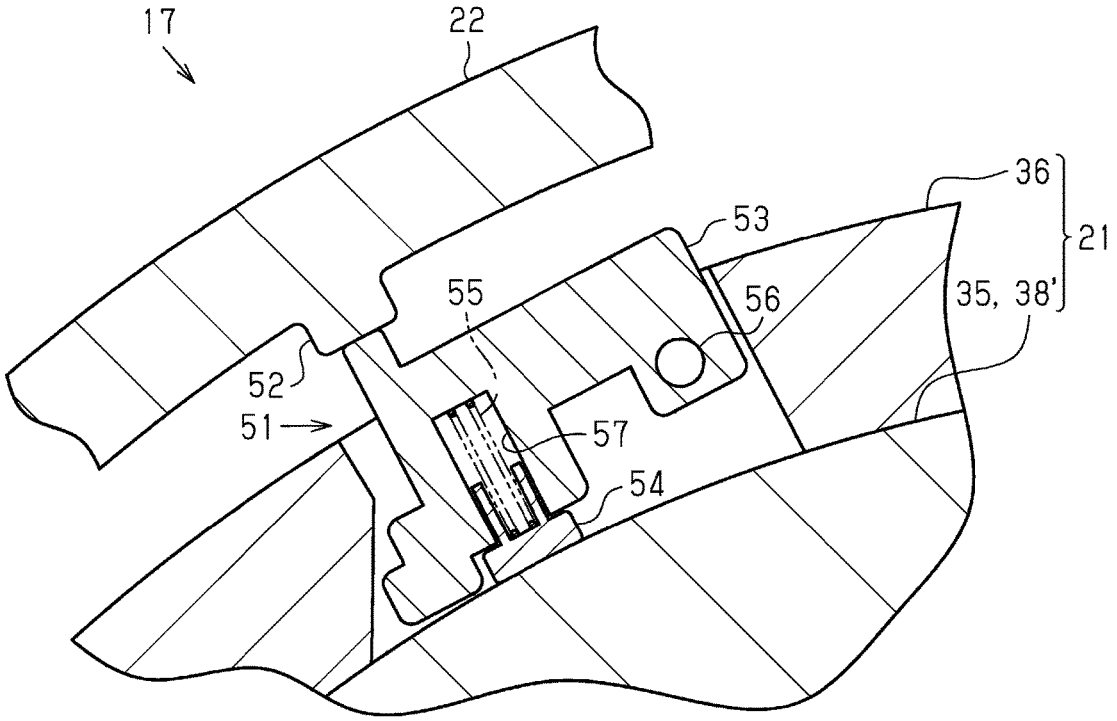
FIG. 10 is a schematic cross-sectional view of a friction member.

As shown in FIG. 10, a projection 52 is preferably formed on the inner surface of the cover 22 which faces the support unit 21. The projection 52 can be in contact with the friction member 51 when the cover 22 is located at the closed position. The projection 52 is continuously formed in the width direction of the cover 22 so as to correspond to the roll R with various widths.

The friction member 51 includes a main body 53, a contact section 54 for contacting with the rotary unit 35, and a bias member 55 such as a spring. The main body 53 is rotatable about the support shaft 56 disposed on the frame 36. The support shaft 56 preferably extends in the width direction as with the shaft 37. The main body 53 has a recess 57 which is open to the rotary unit 35. The contact section 54 is housed in the recess 57 while being in contact with the flange 38'. The bias member 55 is a coil spring, for example, and is disposed between the main body 53 and the contact section 54.

When the cover 22 is located at the closed position, the projection 52 is in contact with the main body 53 and presses the main body 53 against the rotary unit 35. The contact section 54 of the friction member 51 is preferably located on the virtual line between the projection 52 of the cover 22 located at the closed position and the engagement section 39. As a result, the friction member 51 applies a load in the radial direction to the rotary unit 35 of the support unit 21. That is, the friction member 51 applies a load in the radial direction to the flange 38' of the rotary unit 35.

Next, an effect of printing by the transport apparatus 17 with the medium M will be described. As shown in FIG. 9, when the medium M is set with the cover 22 being at the open position, the contact section 54 is in contact with the rotary unit 35. On the other hand, in the main body 53 which is biased by the bias member 55 against the contact section 54, the distal end close to the contact section 54 is located at a position spaced from the rotary unit 35. Accordingly, while the friction force between the contact section 54 and the rotary unit 35 is applied to the rotary unit 35, the friction force applied to the rotary unit 35 is small since the bias member 55 is in an extended state.

As shown in FIG. 10, when the medium M is printed with the cover 22 being at the closed position, the cover 22 presses the friction member 51. Specifically, the projection 52 of the cover 22 is in contact with the main body 53 and rotates the main body 53 so that the distal end of the main body 53 comes closer to the rotary unit 35 resisting the biasing force of the bias member 55. This causes the bias member 55 to contract, and the friction force between the contact section 54 and the rotary unit 35 when the cover 22 is located at the closed position becomes large compared with the friction force when the cover 22 is located at the open position. As a result, when the cover 22 is located at the closed position, the friction member 51 applies a large load to the support unit 21 compared with the case where the cover 22 is located at the open position.

According to the above second embodiment, the following advantageous effects can be obtained in addition to the above advantageous effects of the first embodiment.

(2-1) The position of the support unit 21 that supports the medium M varies depending on the width of the medium M. In this regard, the friction member 51, which is disposed on the support unit 21, can apply a load to the support unit 21 while easily accommodating to varying positions of the support unit 21.

(2-2) Since the friction member 51 applies a load to the support unit 21 in the radial direction, it can efficiently apply a load to the support unit 21 compared with the case of applying a load in the direction different from the radial direction.

The above embodiment may be changed as described in the following modified examples. The above embodiment and the following modified examples may be combined as appropriate.

The support unit 21 may be mounted on the container 20 in a non-removable manner. For example, the roll R may be supported by the support unit which is movable in the width direction after the roll R is housed in the container 20.

The load applying unit 42 may include the driven gear 48 having the width larger than that of the flange 38, and positional variation of the support unit 21 can be accommodated by the driven gear 48. The flange 38 may have a diameter larger than that of the frame 36.

The friction member 51 may apply a load to the support unit 21 in a direction different from the radial direction. For example, the friction member 51 may apply a load to the flange 38 in the axial direction of the shaft 37 (width direction).

The transport apparatus 17 may be configured to include both the load applying unit 42 and the friction member 51. For example, the load applying unit 42 may be disposed on the cover 22 so as to correspond to one of the support units 21, and the friction member 51 may be disposed on the other support unit 21.

The friction member 51 may be disposed on the cover 22. In this case, the main body 53 may be fixed to the cover 22 in a non-rotatable manner.

The load applying unit 42 may be disposed on the support unit 21. For example, the rotary damper 49 may be disposed on the support unit 21 so that the rotary damper 49 and the rotary unit 35 are connected to each other by a gear train disposed on the cover 22 when the cover 22 is located at the closed position.

A pair of support units 21 may be connected to each other. That is, the transport apparatus 17 may include a single support unit 21. For example, the support unit 21 may include the shaft 37 which is larger than the roll R in the width direction, and the flange 38 which is detachably attached to the shaft 37. Of a pair of flanges 38, one flange 38 may be fixed to the shaft 37, and the other flange 38 may be detachably attached to the shaft 37. The load applying unit 42 and the friction member 51 may apply a load to the shaft 37. In this case, the transport apparatus 17 may not necessarily include at least one of the flanges 38.

The transport unit 25 which transports the medium M is not limited to the transport roller 29, but may be a conveyor belt.

The liquid may be selected from any liquid that can be attached to the medium M to thereby perform printing on the medium M. The liquid may include materials in liquid phase such as liquid having high or low viscosity, sol, gel water, other inorganic solvent, organic solvent and liquid solution, and a material in a flowable state such as liquid resin and liquid metal (molten metal). Further, in addition to materials in a liquid state, particles of a functional material made of solid substance such as pigment and metal particles, which are dissolved, dispersed or mixed in a solvent. Typical examples of the liquid include ink. The ink includes various liquid components such as general water-based ink, oil-based ink, gel ink and hot melt ink.

The medium M may be any material that can be wound in a roll-shape, and may be a paper sheet, a film made of resin, a sheet made of resin, a composite film of paper and resin (such as resin impregnated paper or resin coated paper), a metal foil, a metal film, a fabric, a non-woven fabric, or the like.

The printing apparatus 11 may be any apparatus that prints an image such as letters, pictures, or photographs by attaching liquid such as ink or fluid such as toner onto a medium, and may be a serial printer, lateral printer, line printer, page printer, or the like. Further, an offset printing apparatus, a textile printing apparatus, or the like may be used. Further, the printing apparatus may at least have a printing function for printing on a medium, or may be a multi-functional machine having functions other than the printing function.

This application claims priority under 35 U.S.C. § 119 to Japanese Patent Application No. 2017-038473, filed Mar. 1, 2017. The entire disclosure of Japanese Patent Application No. 2017-038473 is hereby incorporated herein by reference.

What is claimed is:

1. A transport apparatus comprising:

a support unit that supports a roll-shaped medium;

a drive unit that rotates the support unit;

a cover configured to cover at least part of the support unit; and a load applying unit that applies a load to the support unit to reduce a rotational force of the support unit, wherein the cover is movable between a closed position at which the cover covers at least part of the support unit and an open position which is different from the closed position, and the load applying unit applies a large load to the support unit when the cover is located at the closed position compared with the case where the cover is located at the open position, wherein the load applying unit is disposed on the cover.

2. The transport apparatus according to claim 1, wherein the support unit includes:

a shaft configured to be inserted into the roll-shaped medium; and a flange having a diameter larger than that of the shaft, wherein the load applying unit applies a load to the flange.

3. A printing apparatus comprising:

the transport apparatus according to claim 2; and a print unit that performs printing on the medium.

4. A printing apparatus comprising:

the transport apparatus according to claim 1; and a print unit that performs printing on the medium.

5. A transport apparatus comprising:

a support unit that supports a roll-shaped medium;

a drive unit that rotates the support unit;

a cover configured to cover at least part of the support unit; and a load applying unit that applies a load to the support unit, wherein the cover is movable between a closed position at which the cover covers at least part of the support unit and an open position which is different from the closed position, and the load applying unit applies a large load to the support unit when the cover is located at the closed position compared with the case where the cover is located at the open position, wherein the load applying unit is disposed on the support unit.

6. The transport apparatus according to claim 1, wherein the load applying unit applies a load to the support unit in a radial direction.

7. A printing apparatus comprising:

the transport apparatus according to claim 6; and a print unit that performs printing on the medium.

8. A printing apparatus comprising:

the transport apparatus according to claim 5; and a print unit that performs printing on the medium.

9. A transport apparatus comprising:

a support unit that supports a roll-shaped medium;

a drive unit that rotates the support unit;

a cover configured to cover at least part of the support unit; and a load applying unit that applies a load to the support unit, wherein the cover is movable between a closed position at which the cover covers at least part of the support unit and an open position which is different from the closed position, and the load applying unit applies a large load to the support unit when the cover is located at the closed position compared with the case where the cover is located at the open position, wherein the load applying unit includes a rotary damper that applies resistance to rotation of the support unit, the support unit and the rotary damper are connected to each other when the cover is located at the closed position, and the support unit and the rotary damper are disconnected from each other when the cover is located at the open position.

10. A printing apparatus comprising:

the transport apparatus according to claim 9; and a print unit that performs printing on the medium.

* * * * *